US009897296B1

(12) United States Patent
Baldwin

(10) Patent No.: US 9,897,296 B1
(45) Date of Patent: Feb. 20, 2018

(54) LAMPHOLDER WITH UNIVERSAL JOINT

(71) Applicant: Jeffrey P. Baldwin, Phoenix, AZ (US)

(72) Inventor: Jeffrey P. Baldwin, Phoenix, AZ (US)

( * ) Notice: Subject to any disclaimer, the term of this patent is extended or adjusted under 35 U.S.C. 154(b) by 0 days.

(21) Appl. No.: 15/264,511

(22) Filed: Sep. 13, 2016

Related U.S. Application Data

(60) Provisional application No. 62/218,378, filed on Sep. 14, 2015.

(51) Int. Cl.

| | |
|---|---|
| ***F21V 21/29*** | (2006.01) |
| ***F21V 21/30*** | (2006.01) |
| ***F21V 21/28*** | (2006.01) |
| *F21S 8/00* | (2006.01) |

(52) U.S. Cl.
CPC ..... *F21V 21/29* (2013.01); *F21V 21/28* (2013.01); *F21V 21/30* (2013.01); *F21S 8/033* (2013.01); *F21S 8/036* (2013.01)

(58) Field of Classification Search
CPC ..... F21V 21/02; F21V 21/26; F21V 21/28; F21V 21/29; F21V 21/30; F21S 8/033; F21S 8/036
See application file for complete search history.

(56) References Cited

U.S. PATENT DOCUMENTS 2,587,917 A * 3/1952 Stone ..... F21V 21/30 16/248
5,258,899 A * 11/1993 Chen ..... F21S 8/033 362/394
5,450,303 A * 9/1995 Markiewicz ..... F16M 11/10 248/183.2
5,504,665 A * 4/1996 Osteen ..... F21V 21/30 362/269
5,599,091 A * 2/1997 Kira ..... F21V 21/30 362/269
5,655,829 A * 8/1997 Lin ..... F21V 21/02 362/145
6,059,429 A * 5/2000 Bodell ..... F21V 21/26 362/269
6,100,803 A * 8/2000 Chang ..... F21V 21/30 250/221
6,161,948 A * 12/2000 Hagen ..... F16M 11/10 362/267
6,902,200 B1 * 6/2005 Beadle ..... F16C 11/04 285/185
8,360,621 B2 * 1/2013 Avila ..... F21V 21/28 362/147

* cited by examiner

*Primary Examiner* — Alexander Garlen
(74) *Attorney, Agent, or Firm* — Booth Udall Fuller, PLC

(57) ABSTRACT

A light fixture allowing a user to tighten a single tightener to simultaneously restrict movement around a first axis and a second orthogonal axis. The light fixture includes a joint housing coupled between an anchor and a light housing assembly, the anchor has a first protrusion rotatably coupled to the joint housing along a first axis, the light housing assembly has a second protrusion rotatably coupled to the joint housing along a second axis, a clamp arm inside the joint housing that has a first end clamp and a second end clamp, and a tightening member is operably coupled to the clamp arm through the joint housing allowing tightening of the tightening member to apply pressure from the first end clamp to the first protrusion and simultaneously apply pressure from the second end clamp to the second protrusion, thereby limiting rotation in both the first and second axes.

20 Claims, 9 Drawing Sheets

FIG. 9A
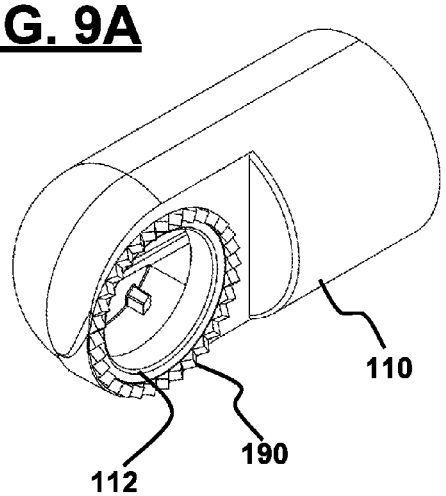
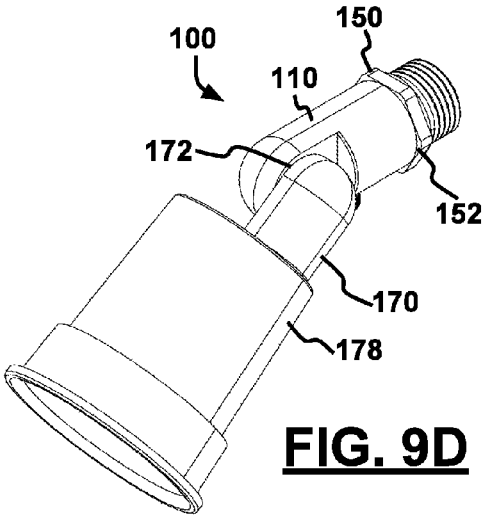
FIG. 9D
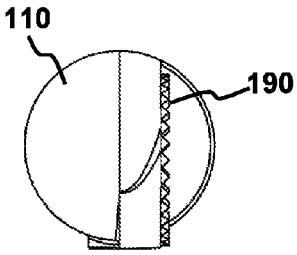
FIG. 9B
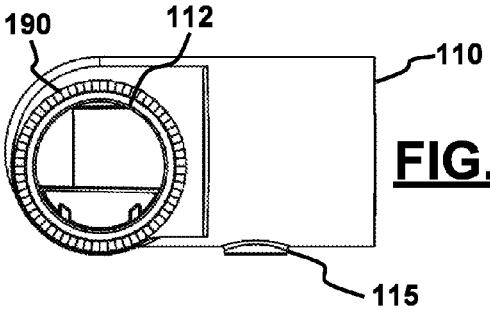
FIG. 9C
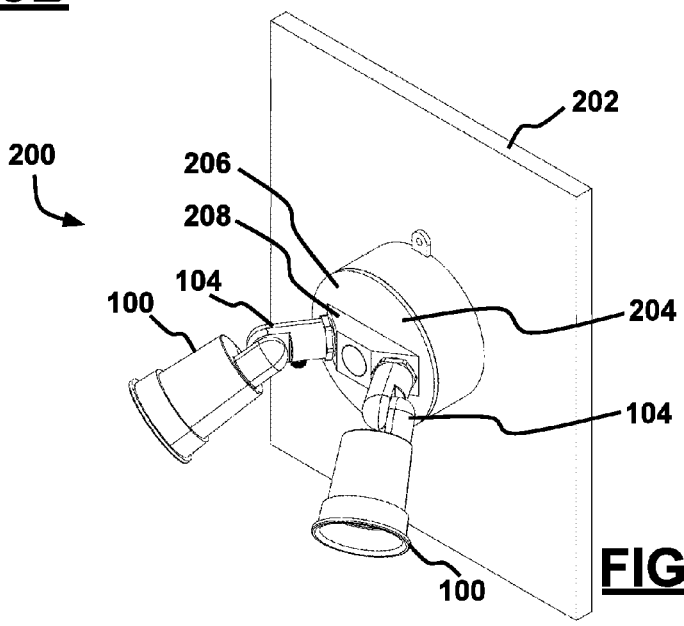
FIG. 10

LAMPHOLDER WITH UNIVERSAL JOINT

CROSS REFERENCE TO RELATED APPLICATIONS

This application claims the benefit of the filing date of U.S. Provisional Patent Application 62/218,378 entitled "Lampholder With Universal Joint" to Jeffrey P. Baldwin which was filed on Sep. 14, 2015, the contents of which are hereby incorporated herein by reference.

BACKGROUND

1. Technical Field

Aspects of this document relate generally to indoor and outdoor light fixtures with a universal joint.

2. Background Art

Light fixtures with one or more light bulbs are found in various outdoor and indoor locations to provide light. Some light fixtures have an arm that can adjustably swivel or move to point a light bulb in different directions. Outdoor security lights commonly have one or two light bulbs where each light bulb is mounted on an adjustable arm allowing the light to be locked in place and pointed at specific areas of a home, yard, or other property.

Many existing lights mounted on adjustable arms utilize two or more couplings allowing movement or adjustment such that each coupling is separately tightened and locked in place. Other adjustably positioned lights have just one coupling that is tightened, but this comes at the expense of limiting movement and degrees of freedom for positioning the light bulb because a second coupling is omitted to reduce the number of elements that must be tightened. A need exists for an improved light fixture having an adjustably positioned light with multiple couplings.

SUMMARY

According to an aspect of the disclosure, a light fixture may comprise a joint housing having a first coupling aperture, a second coupling aperture, and a tightening bore, an anchor having a first coupling, the first coupling having a first protrusion rotatably coupled to the first coupling aperture along a first axis, a light housing assembly having a second coupling, the second coupling having a second protrusion rotatably coupled to the second coupling aperture along a second axis, wherein the first axis is orthogonal to the second axis, a clamp arm positioned within the joint housing, the clamp arm having a first end clamp, a second end clamp, and a tightening boss, wherein the first protrusion has a first annular groove mated with a first friction plate of the first end clamp and the second protrusion has a second annular groove mated with a second friction plate of the second end clamp, and a tightening member threadedly coupled to the tightening boss through the tightening bore, wherein tightening the tightening member applies pressure from the first friction plate to the first protrusion while simultaneously applying pressure from the second friction plate to the second protrusion, thereby limiting rotation in both the first and second axes.

Particular embodiments may comprise one or more of the following features. A first gasket fastened to the first protrusion, and a second gasket fastened to the second protrusion. The joint housing and at least a portion of the light housing assembly may be formed of metal or plastic. The anchor may further comprise teeth mated with teeth on the joint housing, and the light housing assembly further comprises teeth mated with teeth on the joint housing.

According to an aspect of the disclosure, a light fixture may comprise a joint housing having a first coupling aperture, a second coupling aperture, and a tightening bore, an anchor having a first coupling, the first coupling having a first protrusion rotatably coupled to the first coupling aperture along a first axis, a light housing assembly having a second coupling, the second coupling having a second protrusion rotatably coupled to the second coupling aperture along a second axis, wherein the second axis is offset from the first axis by an angle of between 60° and 120°, a clamp arm coupled to the joint housing, the clamp arm having a first end clamp and a second end clamp, and a tightening member operably coupled to the clamp arm through the tightening bore, wherein tightening the tightening member simultaneously applies pressure from the first end clamp to the first protrusion and the second end clamp to the second protrusion, thereby limiting rotation in both the first and second axes.

Particular embodiments may comprise one or more of the following features. The first axis may be orthogonal to the second axis. The tightening member may be threadedly coupled to a tightening boss of the clamp arm through the tightening bore. The first end clamp may comprise an arc shaped first friction plate and the second end clamp comprises an arc shaped second friction plate. An arc of the arc shaped first friction plate may be orthogonal to an arc of the second friction plate. The first protrusion may have an annular groove sized and shaped to mate with a first friction plate of the first end clamp when the tightening member is tightened. The second protrusion may have an annular groove sized and shaped to mate with a second friction plate of the second end clamp when the tightening member is tightened.

According to an aspect of the disclosure, a light fixture may comprise a joint housing having a first coupling aperture, a second coupling aperture, and a tightening bore, an anchor having a first coupling, the first coupling having a first protrusion rotatably coupled to the first coupling aperture along a first axis, a light housing assembly having a second coupling, the second coupling having a second protrusion rotatably coupled to the second coupling aperture along a second axis, a clamp arm coupled to the joint housing, the clamp arm having a first end clamp and a second end clamp, and a tightening member operably coupled to the clamp arm through the tightening bore, wherein tightening the tightening member applies pressure from the first end clamp to the first protrusion and applies pressure from the second end clamp to the second protrusion, thereby limiting rotation in both the first and second axes.

Particular embodiments may comprise one or more of the following features. The clamp arm may be housed in the joint housing. The second axis may be offset from the first axis at an angle of between 60° and 120°. The first end clamp may have a first friction plate shaped to mate with at least a portion of a cross section of the first protrusion. The first protrusion may have a first annular groove mated with a first friction plate of the first end clamp and the second protrusion has a second annular groove mated with a second friction plate of the second end clamp. Tightening the tightening member may limit rotation of the first coupling aperture around the first protrusion by pressing the first friction plate on at least a portion of the first annular groove, and may limit rotation of the second coupling aperture around the second protrusion by pressing the second friction plate on at least a portion of the second annular groove. The first friction plate may be sized and shaped to rotate entirely around the first annular groove and the second friction plate is sized and shaped to rotate around a majority the second annular groove but not rotate entirely around the second annular groove. A power cord housed within the light housing assembly, the joint housing, and the anchor, the power cord passing through the first and second coupling apertures from the anchor to the light housing assembly. The clamp arm may couple the anchor and the light housing assembly to the joint housing when the tightening member is threadedly coupled to the clamp arm through the tightening bore.

Aspects of this document relate to light fixtures. These aspects may comprise, and implementations may include, one or more or all of the components and steps set forth in the appended claims, which are hereby incorporated by reference. In one aspect, a light fixture may include a joint housing having a first coupling aperture, a second coupling aperture, and a tightening bore, an anchor having a first coupling, the first coupling having a first protrusion rotatably coupled to the first coupling aperture along a first axis, a light housing assembly having a second coupling, the second coupling having a second protrusion rotatably coupled to the second coupling aperture along a second axis, a clamp arm coupled to the joint housing, the clamp arm having a first end clamp and a second end clamp, and a tightening member operably coupled to the clamp arm through the tightening bore, wherein tightening the tightening member applies pressure from the first end clamp to the first protrusion and applies pressure from the second end clamp to the second protrusion, thereby limiting rotation in both the first and second axes.

In another aspect, the light fixture may include a joint housing having a first coupling aperture, a second coupling aperture, and a tightening bore, an anchor having a first coupling, the first coupling having a first protrusion rotatably coupled to the first coupling aperture along a first axis; a light housing assembly having a second coupling, the second coupling having a second protrusion rotatably coupled to the second coupling aperture along a second axis, wherein the second axis is offset from the first axis by an angle of between 60° and 120°, a clamp arm coupled to the joint housing, the clamp arm having a first end clamp and a second end clamp, and a tightening member operably coupled to the clamp arm through the tightening bore, wherein tightening the tightening member simultaneously applies pressure from the first end clamp to the first protrusion and the second end clamp to the second protrusion, thereby limiting rotation in both the first and second axes.

Particular embodiments may comprise one or more of the following features. The light fixture may further include a first gasket fastened to the first protrusion and a second gasket fastened to the second protrusion. The joint housing and at least a portion of the light housing assembly may be formed of metal or plastic. The anchor may further include teeth mated with teeth on the joint housing, and the light housing assembly may further include teeth mated with teeth on the joint housing. The first axis may be orthogonal to the second axis. The tightening member may be threadedly coupled to a tightening boss of the clamp arm through the tightening bore. The first end clamp may include an arc shaped first friction plate and the second end clamp may include an arc shaped second friction plate. An arc of the arc shaped first friction plate may be orthogonal to an arc of the second friction plate. The first protrusion may have an annular groove sized and shaped to mate with a first friction plate of the first end clamp when the tightening member is tightened. The second protrusion may have an annular groove sized and shaped to mate with a second friction plate of the second end clamp when the tightening member is tightened. The clamp arm may be housed in the joint housing. The second axis may be offset from the first axis at an angle of between 60° and 120°. The first end clamp may have a first friction plate shaped to mate with at least a portion of a cross section of the first protrusion. The first protrusion may have a first annular groove mated with a first friction plate of the first end clamp and the second protrusion may have a second annular groove mated with a second friction plate of the second end clamp. Tightening the tightening member may limit rotation of the first coupling aperture around the first protrusion by pressing the first friction plate on at least a portion of the first annular groove, and may limit rotation of the second coupling aperture around the second protrusion by pressing the second friction plate on at least a portion of the second annular groove. The first friction plate may be sized and shaped to rotate entirely around the first annular groove and the second friction plate may be sized and shaped to rotate around a majority the second annular groove but not rotate entirely around the second annular groove. The light fixture may further include a power cord housed within the light housing assembly, the joint housing, and the anchor, the power cord passing through the first and second coupling apertures from the anchor to the light housing assembly. The clamp arm may couple the anchor and the light housing assembly to the joint housing when the tightening member is threadedly coupled to the clamp arm through the tightening bore.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that he can be his own lexicographer if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and:

FIG. 9A is a perspective view of a non-limiting example of an alternative implementation of a joint housing where one or both of the first coupling and the second coupling include a friction enhancing surface, such as teeth;

FIG. 9B is a front view of FIG. 6A;

FIG. 9C is a right side view of FIG. 6A;

FIG. 9D is a perspective view of a light fixture employing the joint housing of FIGS. 9A-C;

FIG. 10 is a perspective view of two light fixtures mounted on a mounting assembly;

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DESCRIPTION

This document features a light fixture. There are many features of a light fixture and method implementations disclosed herein, of which one, a plurality, or all features or steps may be used in any particular implementation.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

Figure 1:
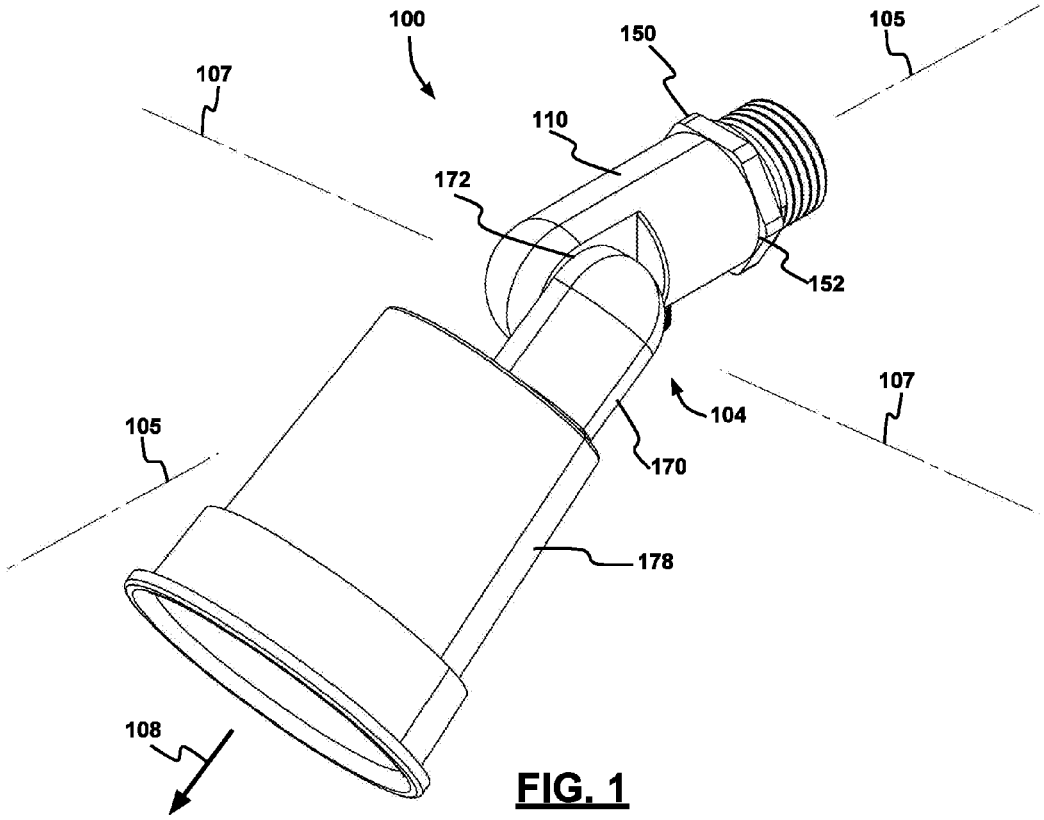
FIG. 1 is a perspective view of a non-limiting implementation of a light fixture.

FIG. 1 illustrates a perspective view of a non-limiting implementation of a light fixture 100. Light fixture 100 includes an adjustable arm assembly 104 that may be adjustably positioned to direct emitted light 108 from a light bulb (not shown) mounted in a socket (see FIGS. 11A-D) housed in a housing 178. Emitted light 108 shown in FIG. 1 is meant to depict a general direction of where the light bulb is pointed and does not represent the actual path of photons or the field of view of light exiting the light bulb. Housing 178 may have various shapes or lengths, for example: housing 178 may cover just the base of a light bulb (as shown in FIG. 1); housing 178 may operate as a shroud to focus the emitted light 108 into a spot beam; or housing 178 may operate as a shroud and allow the emitted light 108 to spread across a wide field of view.

The adjustable arm assembly 104 includes a first coupling 152 allowing rotation around a first axis 105 and a second coupling 172 allowing rotation around a second axis 107. A joint housing 110 couples to an anchor 150 and a light housing assembly 170. The joint housing 110 may rotate around the first axis 105 at the first coupling 152, where the joint housing 110 rotates with respect to the anchor 150. The light housing assembly 170 may rotate around the second axis 107 at the second coupling 172, where the light housing assembly 170 rotates with respect to the joint housing 110. Couplings 152 and 172 allow emitted light 108 to be pointed anywhere within: a conical field (with the anchor 150 at the apex); part or all of a hemisphere (with the anchor 150 at the center of the sphere); or an entire hemisphere plus some to most of the other hemisphere (with the anchor 150 at the center of the sphere).

In some implementations the first axis 105 is orthogonal to the second axis 107. In certain implementations, the second axis 107 is offset from the first axis 105 by an angle of: between 45° and 135°; between 60° and 120°; between 70° and 110°; between 75° and 105°; between 80° and 100°; or between 85° and 95°. In some implementations the first axis 105 is considered to be orthogonal to the second axis 107 by having the second axis 107 positioned offset from the first axis 105 by an angle of: preferably 90° with a tolerance of ±8°; preferably 90° with a tolerance of ±5°; preferably 90° with a tolerance of ±3°; or preferably 90° with a tolerance of ±1.5°.

Figure 2:
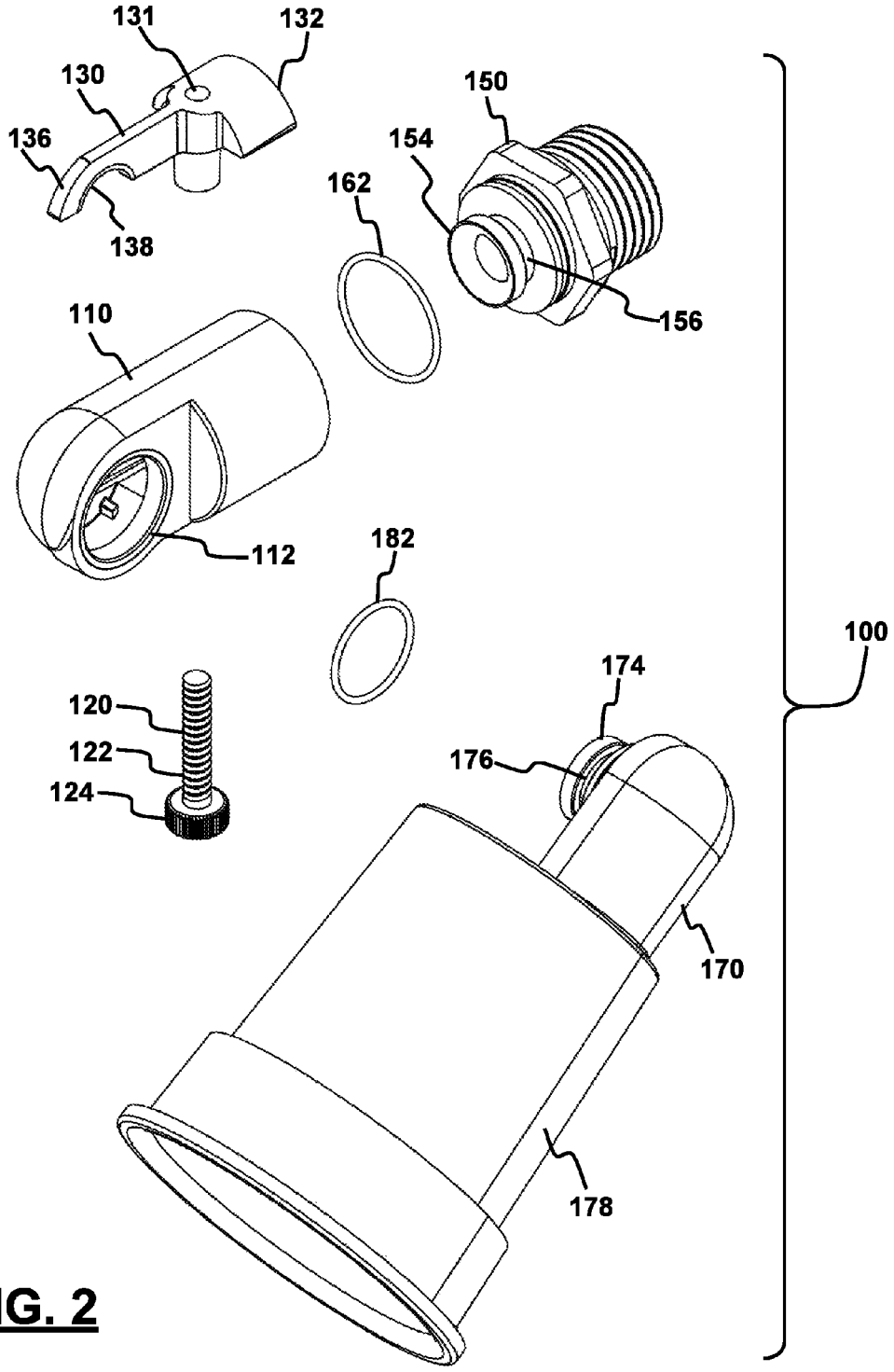
FIG. 2 is an exploded perspective view of a non-limiting implementation of light fixture.

FIG. 2 depicts an exploded perspective view of a non-limiting implementation of light fixture 100. The light fixture 100 may include a clamp arm 130, a first end clamp 132, a first friction plate 134 (see FIG. 3C), a second end clamp 136, a second friction plate 138, a tightening bore 131, a tightener 120, a joint housing 110, a first coupling aperture 111 of the joint housing 110 (see FIG. 3D), a second coupling aperture 112 of the joint housing 110, an anchor 150, a first protrusion 154, a first annular groove 156, a first gasket 162, a light housing assembly 170, a second protrusion 174, a second annular groove 176, and a second gasket 182. The clamp arm 130 is housed inside the joint housing 110 and the clamp arm 130 couples with tightener 120 at the tightening bore 131. The first friction plate 134 is positioned in the first annular groove 156 and the second friction plate 138 is positioned in the second annular groove 176. By tightening the tightener 120, the first end clamp 132 tightens around the first protrusion 154 while simultaneously tightening the second end clamp 136 around the second protrusion 174. Thus, a single tightener 120 operates to simultaneously limit or fix rotation of both the first axis 105 and the second axis 107.

In some implementations, the light fixture 100 includes at least the following: a clamp arm 130, a first end clamp 132, a second end clamp 136, a tightener 120, a joint housing 110, an anchor 150, a first protrusion 154, a light housing assembly 170, and a second protrusion 174. In certain implementations, the light fixture 100 includes at least the following: a clamp arm 130, a first end clamp 132, a first friction plate 134, a second end clamp 136, a second friction plate 138, a tightening bore 131, a tightener 120, a joint housing 110, a first coupling aperture 111 of the joint housing 110, a second coupling aperture 112 of the joint housing 110, an anchor 150, a first protrusion 154, a light housing assembly 170, and a second protrusion 174.

In certain implementations, at least one of the clamp arm 130, joint housing 110, anchor 150, and light housing assembly 170, is formed of at least one of the following materials: metals; alloys; plastics; polymers; rubbers; polymers; and/or any combination of the foregoing. In some implementations, at least one of the clamp arm 130, joint housing 110, anchor 150, and light housing assembly 170, is primarily formed of at least one of the following materials: metals; alloys; plastics; polymers; and/or any combination of the foregoing.

Gaskets, such as first gasket 162 and second gasket 182, or other weather-resistant or sealing mechanisms may be used with light fixture 100. Gaskets 162 and 182 may be synthetic or natural rubber, plastic, or a similar flexible sealant. First gasket 162 removably or permanently fastens to the first protrusion 154 so that the first gasket 162 restricts liquid from passing the interface between the first protrusion 154 and the first coupling aperture 111. Similarly, second gasket 182 removably or permanently fastens to the second protrusion 174 so that the second gasket 182 restricts liquid from passing the interface between the second protrusion 174 and the second coupling aperture 11. Thus, the first gasket 162 operates to seal or restrict liquid from passing the first coupling 152 and the second gasket 182 operates to seal or restrict liquid from passing the second coupling 172, thereby at least limiting the ability of water to enter through the first coupling 152 or the second coupling 174. In some implementations, light fixture 100 includes: both first gasket 162 and second gasket 182; first gasket 162 but not second gasket 182; second gasket 182 but not first gasket 162; or neither first gasket 162 nor second gasket 182. In certain implementations, additional gaskets, seals, membranes, or the like are used in addition to or in lieu of one or more of gaskets 162/182 for sealing coupling 152 and/or 172.

Figure 3A:
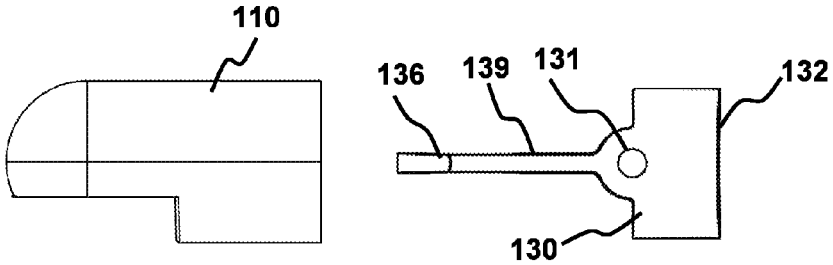
FIG. 3A is a top view of a non-limiting implementation of a joint housing and a clamp arm.
Figure 3B:
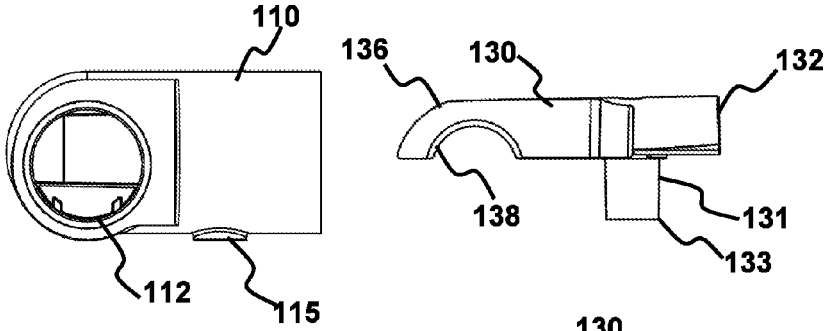
FIG. 3B is a right side view of FIG. 3A.
Figure 3C:
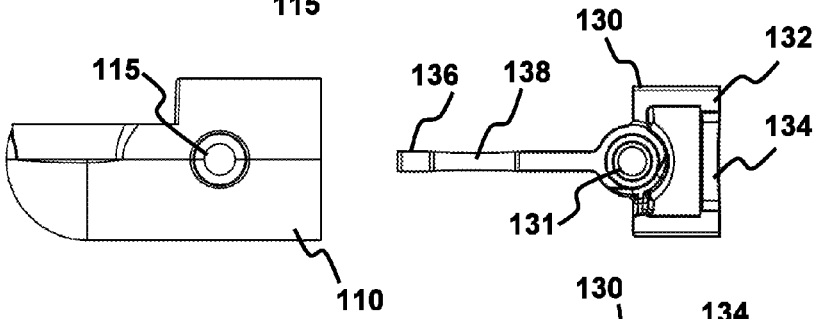
FIG. 3C is a bottom view of FIG. 3A.
Figure 3D:
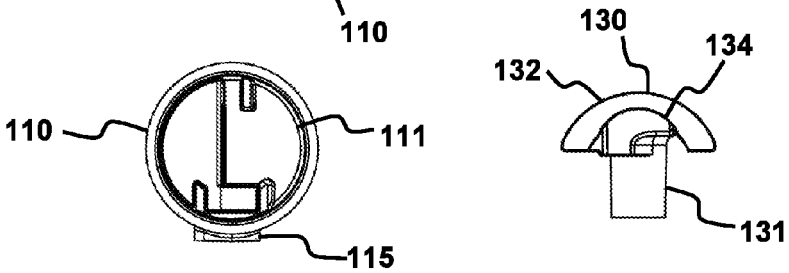
FIG. 3D is a rear view of a non-limiting implementation of a joint housing and a clamp arm.
Figure 3E:
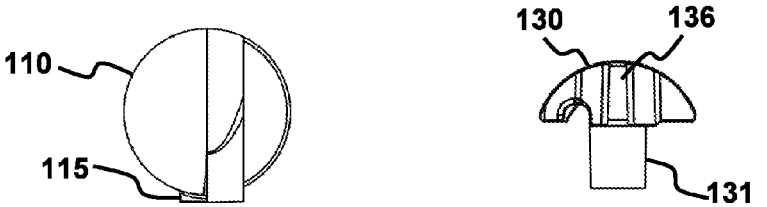
FIG. 3E is a front view of FIG. 3D

FIGS. 3A-E depict five different views of a non-limiting implementation of a joint housing 110 and a clamp arm 130. Specifically, FIG. 3A depicts a top view thereof; FIG. 3B depicts a right side view thereof; FIG. 3C depicts a bottom view thereof; FIG. 3D depicts a rear view thereof; FIG. 3E depicts a front view thereof. Clamp arm 130 has a size and a shape such that clamp arm 130 may be housed within the joint housing 110. The clamp arm 130 slides into the coupling aperture 111 and fits within the joint housing with the first end clamp 132 proximate the first coupling aperture 111, the second end clamp 136 proximate the second coupling aperture 112, and the tightening boss 131 being positioned substantially coaxially with the tightening bore 115.

In some implementations the first friction plate 134 is orthogonal to the second friction plate 138. In certain implementations, the second friction plate 138 is offset from the friction plate 134 by an angle of: between 45° and 135°; between 60° and 120°; between 70° and 110°; between 75° and 105°; between 80° and 100°; or between 85° and 95°. In some implementations the friction plate 134 is considered to be orthogonal to the second friction plate 138 by having the second friction plate 138 positioned offset from the friction plate 134 by an angle, in various embodiments, of: 90° with a tolerance of ±8°; 90° with a tolerance of ±5°; 90° with a tolerance of ±3°; or 90° with a tolerance of ±1.5°. In some implementations the first friction plate 134 is orthogonal to first axis 105 and the second friction plate 138 is orthogonal to the second axis 107. In certain implementations the first friction plate 134 is parallel to first annular groove 156 when the light fixture 100 is assembled and tightened. In some implementations the second friction plate 138 is parallel to second annular groove 176 when the light fixture 100 is assembled and tightened.

Figure 4B:
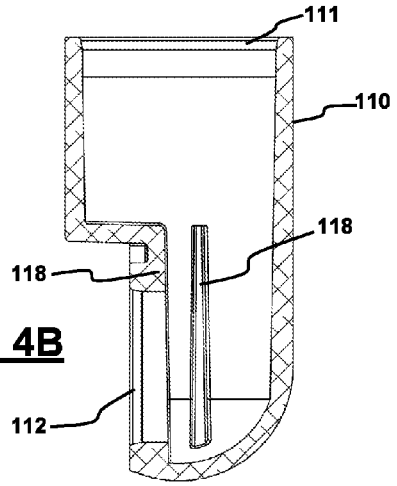
FIG. 4B is a sectional view of FIG. 4A.
Figure 4A:
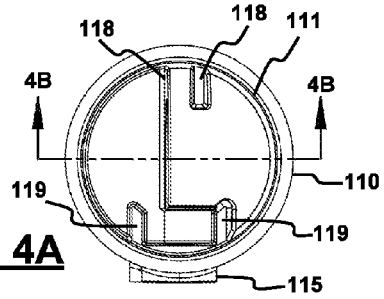
FIG. 4A is a rear view of a joint housing.
Figure 4C:
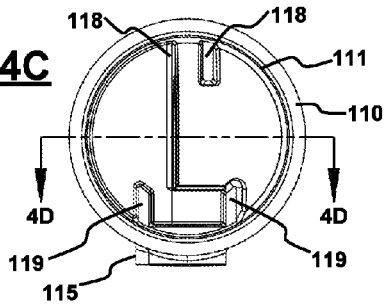
FIG. 4C is a rear view of a joint housing.
Figure 4D:
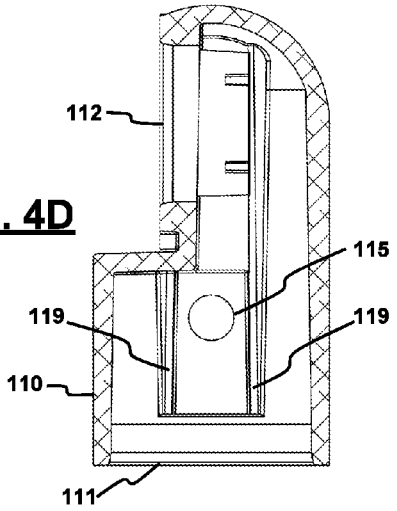
FIG. 4D is a sectional view of FIG. 4C.
Figure 5A:
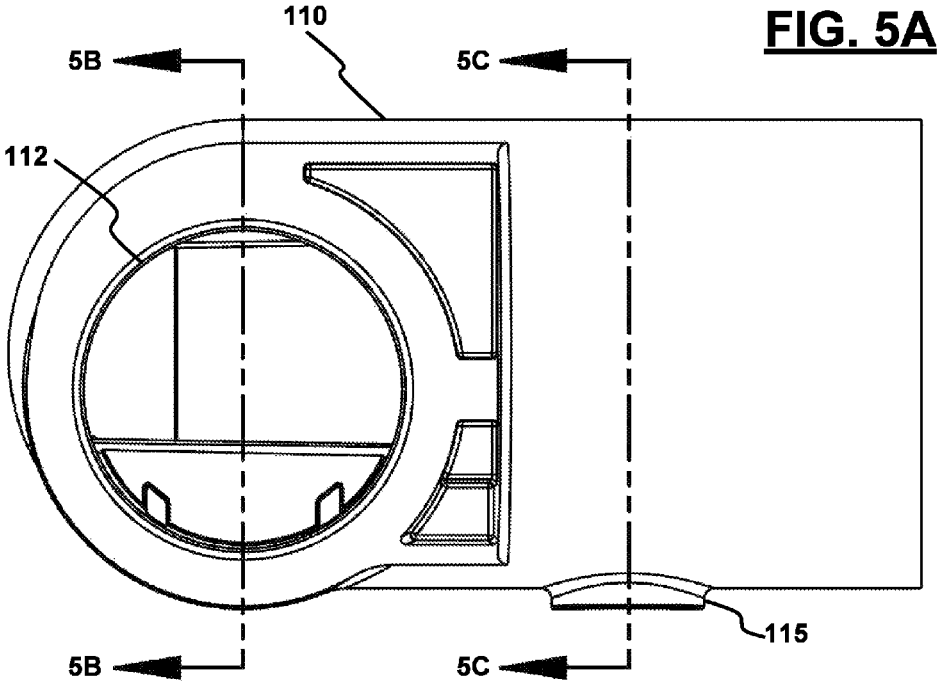
FIG. 5A is a right side view of a joint housing.
Figure 5B:
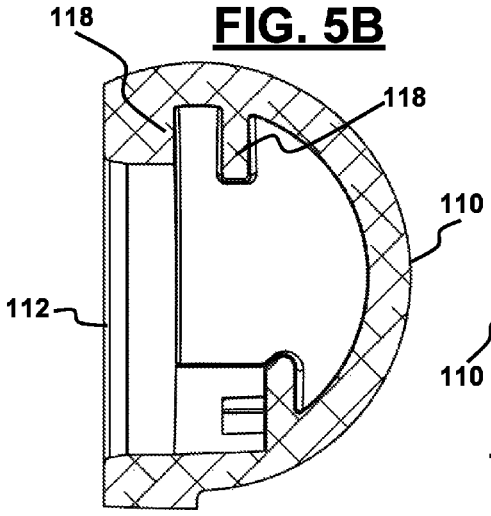
FIG. 5B is a sectional view of FIG. 5A.
Figure 5C:
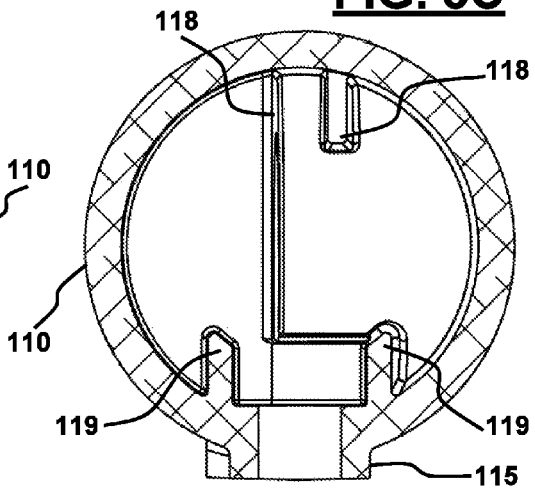
FIG. 5C is a sectional view of FIG. 5A.

FIGS. 4A and 4C depict rear views of a joint housing 110 while FIGS. 4B and 4D depict cross-sectional views thereof. FIG. 5A depicts a right side view of a joint housing 110 while FIGS. 5B and 5C depict cross-sectional views thereof. In some implementations, joint housing 110 includes one or more of a top guide 118 or a bottom guide 119 that operate to orient the clamp arm 130 when it is housed within joint housing 110 and/or orient the clamp arm 130 when it is being slid into the joint housing 110. The top guide 118 may operate to guide the neck 139 (see FIG. 3A) of the clamp arm 130 into position within the joint housing 110 so that the second end clamp 136 is positioned over or near the second coupling aperture 112. The bottom guide 119 may operate to guide the base 133 (see FIG. 3B) of the tightening boss 131 into position within the joint housing 110 so that the first end clamp 132 is positioned over or near the first coupling aperture 111. The top guide 118 and/or the bottom guide 119 may include grooves, guides, slots, seats, or the like that guide the clamp arm 130 into place as the clamp arm 130 is slid into place within the joint housing 110.

Figure 6A:
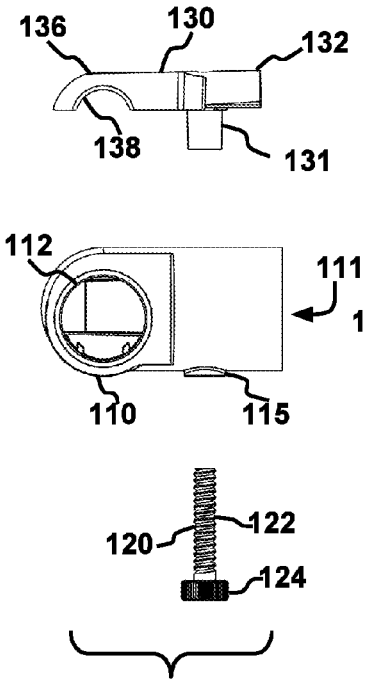
FIG. 6A is a right side view of a non-limiting implementation of a tightener shown in coaxial alignment with the tightening boss of the clamp arm and the tightening bore of the joint housing.
Figure 6B:
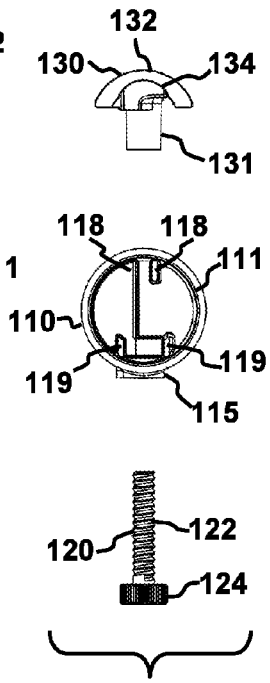
FIG. 6B is a rear view of FIG. 6A.
Figure 6C:
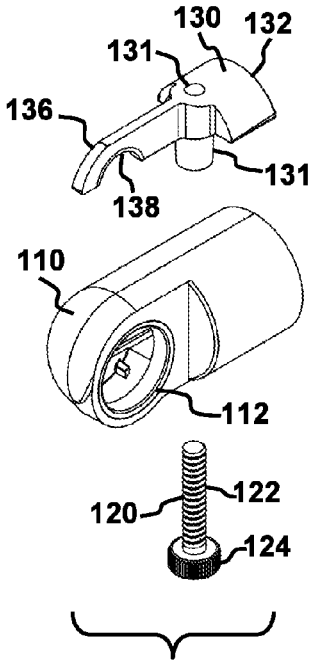
FIG. 6C is a perspective view of FIG. 6A.

FIGS. 6A-C depict three different views of a non-limiting implementation of a tightener 120 shown in coaxial alignment with the tightening boss 131 of the clamp arm 130 and the tightening bore 115 of the joint housing 110, where: FIG. 6A depicts a right side view thereof; FIG. 6B depicts a rear view thereof; and FIG. 6C depicts a perspective view thereof. For simplifying the view, the clamp arm 130 depicted in FIGS. 6A-C is shown outside the joint housing 110 to assist in showing alignment of the tightener 120 together with the tightening boss 131 and the tightening bore 115, but the light fixture operates by having the tightener 120 couple to the tightening boss 131 by passing through the tightener bore 115 when the clamp arm 130 is housed within the joint housing 110.

Figure 7:
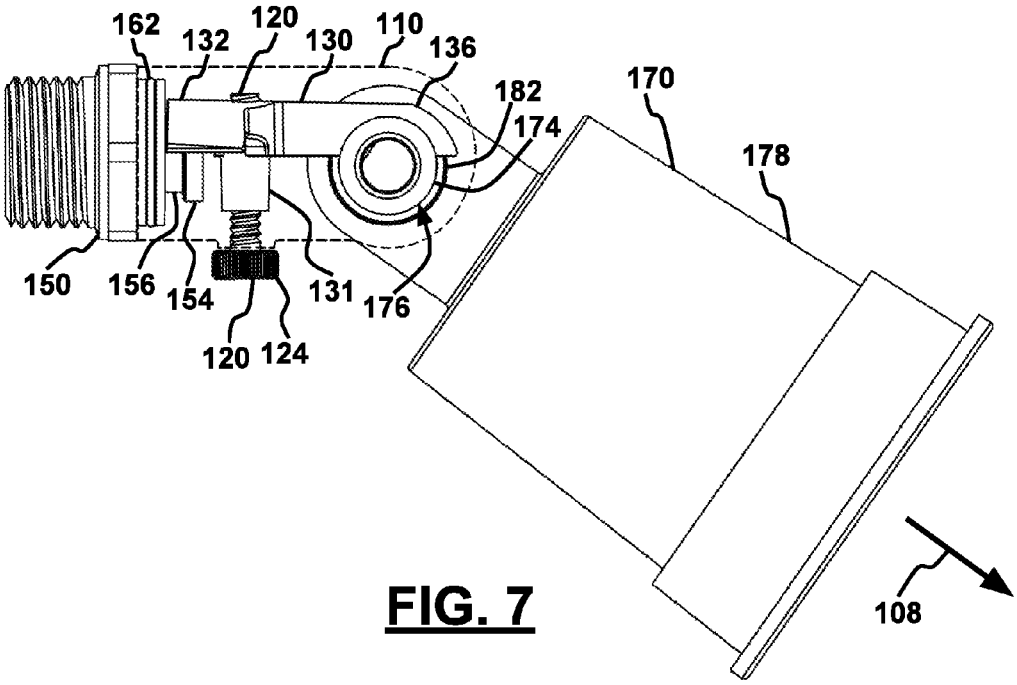
FIG. 7 is a left side view of a light fixture with the joint housing omitted to depict the fitment and workings of the clamp arm housed within the joint housing.

FIG. 7 depicts left side view of a light fixture 100 with the joint housing 110 omitted to depict the fitment and workings of the clamp arm 130 housed within the joint housing 110. The clamp arm 130 housed within the joint housing 110 (omitted but shown as dashed outline in FIG. 7) operates by tightening or loosening tightener 120. By tightening the tightener 120, the first end clamp 132 clamps down on the first annular groove 156 while the second end clamp 136 simultaneously clamps down on the second annular groove 176. Thus, tightening the tightener 120 operates to limit and restrict rotation of both: the first coupling 152 around the first axis 105; and the second coupling 172 around the second axis 107. Conversely, loosening the tightener 120 allows the first end clamp 132 to release from the first annular groove 156 simultaneously as the second end clamp 136 releases from the second annular groove 176, thereby enabling rotation of the first coupling 152 around the first axis 105 and the second coupling 172 around the second axis 107. Accordingly, a user may tighten a single tightener 120 of the light fixture 100 and position the emitted light 108 by simultaneously locking first coupling 152 and second coupling 172 in place and restricting movement around axes 105 and 107. It follows that a user may also release the clamped tension from the clamp arm 130 holding emitted light 108 fixed in place by loosening tightener 120 sufficient to allow rotation around both the first axis 105 and the second axis 107. Therefore, a single tightener 120 allows two couplings (e.g., first coupling 152 and second coupling 172) to be locked in place or loosened by simply engaging or releasing just the tightener 120.

Figure 8B:
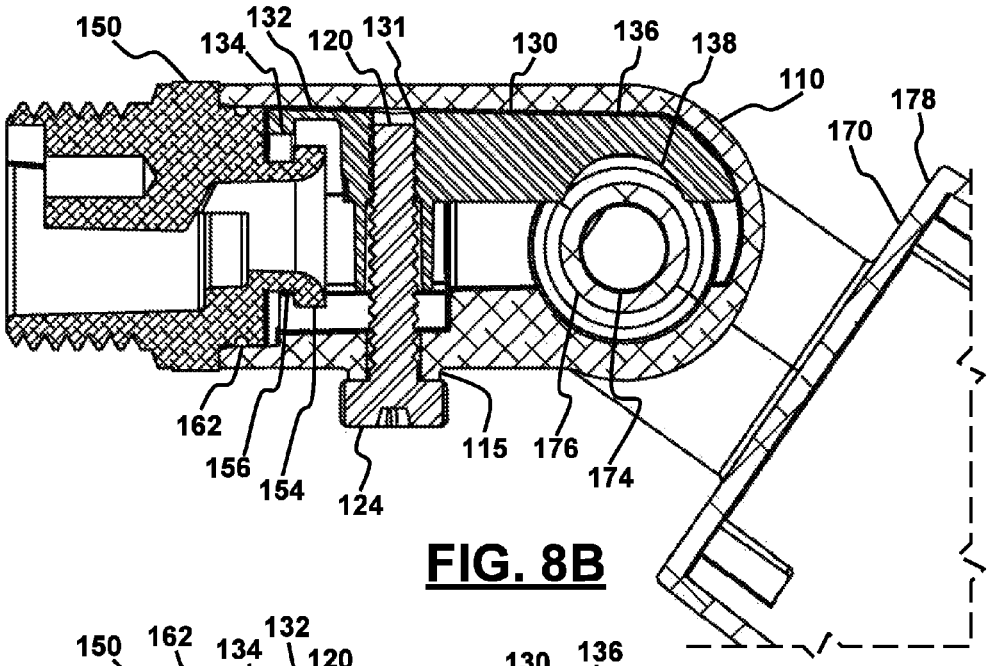
FIG. 8B is a sectional view of FIG. 8A.
Figure 8C:
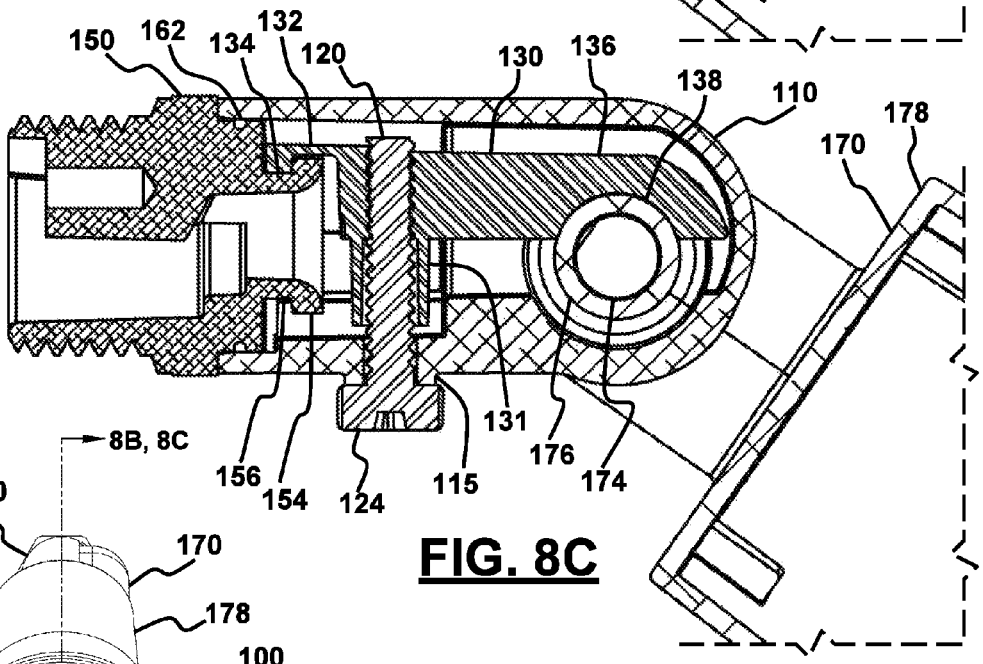
FIG. 8C is a sectional view of FIG. 8A.
Figure 8A:
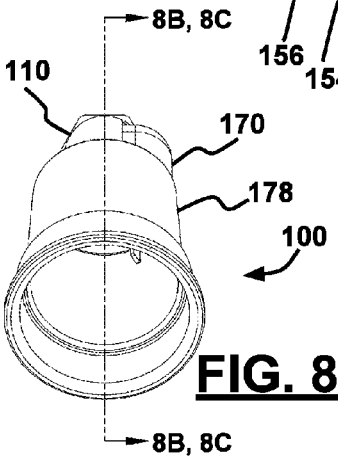
FIG. 8A is a front view of a light fixture.

FIG. 8A depicts a front view of a light fixture 100 while FIGS. 8B and 8C depict partial cross-sectional views thereof. Specifically, FIG. 8B depicts tightener 120 loosened sufficient to permit rotation of the first coupling 152 around the first axis 105 and the second coupling 172 around the second axis 107. Conversely, FIG. 8C depicts tightener 120 tightened sufficient to lock, limit or restrict rotation of the first coupling 152 around the first axis 105 and the second coupling 172 around the second axis 107. When the clamp arm 130 is housed within the joint housing 110 and the tightening boss 131 is substantially coaxially aligned with the tightening bore 115, the tightener 120 is inserted through the aperture of tightening bore 115 to couple to the tightening boss 131 (e.g., by screwing in screw 122 into tightening boss 131). The first protrusion 154 is inserted into the first coupling aperture 111 and the second protrusion 174 is inserted into the second coupling aperture 112 resulting in a loose configuration such as shown in FIG. 8B. While clamp arm 130 is loose, the first friction plate 134 of the first end clamp 132 is positioned over or near the first annular groove 156 and the second friction plate 138 of the second end clamp 136 is positioned over or near the second annular groove 176. As shown in FIG. 8C, the tightening the tightener 130 sufficient to engage the first and second end clamps 132 and 136 operates to simultaneously restrict rotation of the first coupling 152 around the first axis 105 and the second coupling 172 around the second axis 107. When the tightener 120 engages the clamp arm 130 in a tightened position (as shown in FIG. 8C), the first friction plate 134 engages with and applies pressure to the first annular groove 156 while the second friction plate 138 simultaneously engages with and applies pressure to the second annular groove 176.

The arced shape of the first friction plate 134 is shaped to mate with the arc of the first annular groove 156. Similarly, the arced shape of the second friction plate 138 is shaped to mate with the arc of the second annular groove 176. Shaping the surface of the first and second friction plates 134 and 138 allows the entire surface of the friction plates 134/138 to engage and apply friction and pressure against the respective annular grooves 156/176. In some implementations, the surface of one or more of the friction plates 134/138 or annular grooves 156/176 may be textured (e.g., teeth, abrasions, undulations, grooves, etc.) or made from a friction promoting material (e.g., rubber) to increase the friction under pressure from end clamps 132 and 136.

In some implementations, the first friction plate 134 can circumnavigate the entire first annular groove 156 around the first axis 105. In some implementations, the second friction plate 138 can circumnavigate at least 33%, 40%, 50%, 60%, 75% or 85% of the circumference of the second annular groove 176 around the second axis 107. In certain implementations, the first friction plate 134 is sized and shaped to rotate entirely around the first annular groove 156 and the second friction plate 138 is sized and shaped to rotate around a majority of the second annular groove 176, but not rotate entirely around the second annular groove 176.

In some implementations, the tightening bore 115 is not threaded, which allows tightener 120 to pass through the tightening bore 115 without threadedly coupling to the tightening bore 115. For example, tightening a tightener 120 that is a screw 122 causes clamp arm 130 to engage the end clamps 132/136 on annular grooves 156/176 by the pressure between the head 124 of screw 122 against the joint housing 110 and the threadedly engaged screw 122 in the tightening boss 131. In certain implementations, the tightener 120 is a coupler or fastener other than a screw, such as an over-center cam, or other latches or fasteners.

In some implementations, the clamp arm 130 is not entirely housed within the joint housing 110. For example, the joint housing 110 may include a slot that the clamp arm 130 fits into (not shown) so that at least a portion or edge of the clamp arm 130 is visible on the outside of light fixture 100.

FIGS. 9A-D depict non-limiting examples of an alternative implementation where one or both of first coupling 152 and second coupling 172 include a friction enhancing surface, such as teeth 190. Using an example of teeth 190 on second coupling 172 as shown in FIGS. 9A-C, teeth 190 may be on one or both of the joint housing 110 and the light housing assembly 170. Likewise, one or both sides of the first coupling 152 may include teeth 190 (not shown). Teeth 190 assist in providing additional friction and resistance to rotation unless the tightener 120 is loosened sufficient to allow the coupling(s) 152/172 to rotate without interference of teeth 190. Some implementations employ teeth 190 having a depth of 0.2 mm to 3 mm, or preferably 0.4 mm to 2 mm. In some implementations teeth 190 have an alternative texture than the teeth shown in FIGS. 9A-C (e.g., other teeth, abrasions, undulations, grooves, hash marks, etc.) or are made from a friction promoting material (e.g., rubber).

FIG. 10 depicts two light fixtures 100 mounted on a mounting assembly 200. The mounting assembly 200 may include at least a mounting plate assembly 204 attached to a cover 202. The mounting plate assembly 204 includes at least a mounting plate 206 and optionally includes an anchor mount 208 as well. The anchor 150 of the light fixture 100 threadedly couples to the mounting plate 206, for example, by removably fastening to the anchor mount 208 of the mounting plate 206. The mounting plate 206 is not limited to a circular or cylindrical shape as shown in FIG. 10, and the mounting plate 206 can have a wide variety of geometric, ornamental or irregular shapes. Similarly, the cover 202 may have various other shapes aside from the square shape shown. The mounting assembly 200 may be an outdoor security light system where a motion detector triggers one or more attached light fixtures 100 to turn on after motion is sensed.

Figure 11A:
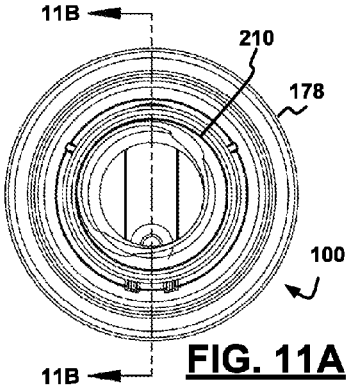
FIG. 11A is a front view of a light fixture.
Figure 11B:
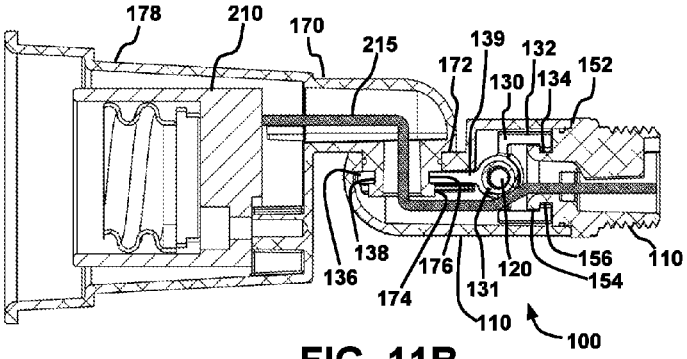
FIG. 11B is a sectional view of FIG. 11A.
Figure 11C:
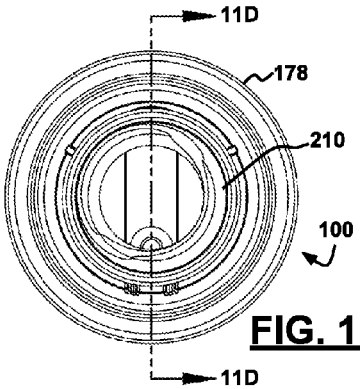
FIG. 11C is a front view of a light fixture.
Figure 11D:
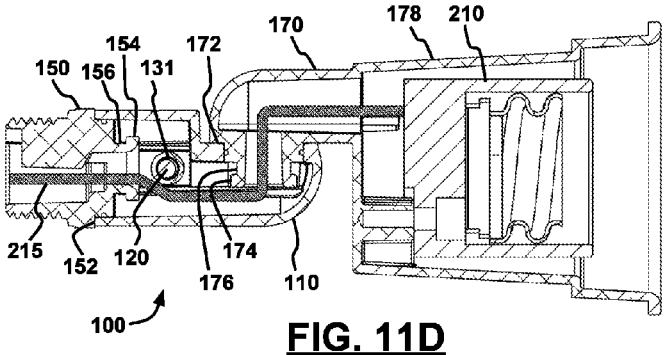
FIG. 11D is a sectional view of FIG. 11C.

FIGS. 11A and 11C depict front views of a light fixture 100 while FIGS. 11B and 11D depict cross-sectional views thereof. Light fixture 100 includes a socket 210 where a light bulb may be inserted to be powered and operated for shining light in a direction of emitted light 108 based on the locked position of the first coupling 152 and the second coupling 172. Light socket 210 receives electrical power from a power cord 215. Power cord 215 is routed internally through the adjustable arm assembly 104 of the light fixture 100. Specifically, the power cord 215 passes through the interior cavity of anchor 150, enters the first coupling aperture 111, exits through an aperture in the first protrusion 154, passes through the interior cavity of joint housing 110, enters through an aperture in the second protrusion 174, exits the second coupling aperture 112, passes through the interior cavity of light housing assembly 170, and finally couples electrically and physically to socket 210 located in housing 178.

The power cord 215 is made of flexible wire(s) and plastic or another flexible material coating the wire(s). The flexible nature of the power cord 215 allows the first coupling 152 to permit rotation around the first axis 105 and the second coupling 172 to permit rotation around the second axis 107. Thus, the power cord 215 is protectively housed within the adjustable arm assembly 104 by being routed internally through the anchor 150, the joint housing 110, and the light housing assembly 170.

It will be understood that light fixture implementations are not limited to the specific assemblies, devices and components disclosed in this document, as virtually any assemblies, devices and components consistent with the intended operation of a light fixture implementation may be utilized. Accordingly, for example, although particular light fixtures, housings, anchors, joints, protrusions, clamps, grooves, plates, teeth, couplers, fasteners, power sockets, and other assemblies, devices and components are disclosed, such may include any shape, size, style, type, model, version, class, measurement, concentration, material, weight, quantity, and/or the like consistent with the intended operation of a light fixture implementation. Implementations are not limited to uses of any specific assemblies, devices and components; provided that the assemblies, devices and components selected are consistent with the intended operation of a light fixture implementation.

Accordingly, the components defining any light fixture implementations may be formed of any of many different types of materials or combinations thereof that can readily be formed into shaped objects provided that the components selected are consistent with the intended operation of a light fixture implementation. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof.

For the exemplary purposes of this disclosure, sizing, dimensions, and angles of light fixture implementations may vary according to different implementations.

Various light fixture implementations may be manufactured using conventional procedures as added to and improved upon through the procedures described here. Some components defining light fixture implementations may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that the assembly of light fixtures are not limited to the specific order of steps as disclosed in this document. Any steps or sequence of steps of the assembly of light fixtures indicated herein are given as examples of possible steps or sequence of steps and not as limitations, since various assembly processes and sequences of steps may be used to assemble light fixtures.

The light fixture implementations are described being used to adjustably orient a light bulb and lock the light bulb in a particular orientation. Nevertheless, implementations are not limited to uses relating to the foregoing. Rather, any description relating to the foregoing is for the exemplary purposes of this disclosure, and implementations may also be used with similar results for a variety of other applications requiring an adjustable arm assembly. For example, implementations may be used to adjustably position an arm holding objects other than a light bulb, such as one or more of a: workpiece, optical aid, computer monitor, television, mobile phone, paper, mirror, audio speaker, workplace devices, a universal clamp, a fastener, and so on.

The invention claimed is:

1. A light fixture comprising:

a joint housing having a first coupling aperture, a second coupling aperture, and a tightening bore;

an anchor having a first coupling, the first coupling having a first protrusion rotatably coupled to the first coupling aperture along a first axis;

a light housing assembly having a second coupling, the second coupling having a second protrusion rotatably coupled to the second coupling aperture along a second axis, wherein the first axis is orthogonal to the second axis;

a clamp arm positioned within the joint housing, the clamp arm having a first end clamp, a second end clamp, and a tightening boss, wherein the first protrusion has a first annular groove mated with a first friction plate of the first end clamp and the second protrusion has a second annular groove mated with a second friction plate of the second end clamp; and a tightening member threadedly coupled to the tightening boss through the tightening bore, wherein tightening the tightening member applies pressure from the first friction plate to the first protrusion while simultaneously applying pressure from the second friction plate to the second protrusion, thereby limiting rotation in both the first and second axes.

2. The light fixture of claim 1, further comprising:

a first gasket fastened to the first protrusion; and a second gasket fastened to the second protrusion.

3. The light fixture of claim 1 wherein the joint housing and at least a portion of the light housing assembly are formed of metal or plastic.

4. The light fixture of claim 1 wherein:

the anchor further comprises teeth mated with teeth on the joint housing; and the light housing assembly further comprises teeth mated with teeth on the joint housing.

5. A light fixture comprising:

a joint housing having a first coupling aperture, a second coupling aperture, and a tightening bore;

an anchor having a first coupling, the first coupling having a first protrusion rotatably coupled to the first coupling aperture along a first axis;

a light housing assembly having a second coupling, the second coupling having a second protrusion rotatably coupled to the second coupling aperture along a second axis, wherein the second axis is offset from the first axis by an angle of between 60° and 120°;

a clamp arm coupled to the joint housing, the clamp arm having a first end clamp and a second end clamp; and a tightening member operably coupled to the clamp arm through the tightening bore, wherein tightening the tightening member simultaneously applies pressure from the first end clamp to the first protrusion and the second end clamp to the second protrusion, thereby limiting rotation in both the first and second axes.

6. The light fixture of claim 5 wherein the first axis is orthogonal to the second axis.

7. The light fixture of claim 5 wherein the tightening member is threadedly coupled to a tightening boss of the clamp arm through the tightening bore.

8. The light fixture of claim 5 wherein the first end clamp comprises an arc shaped first friction plate and the second end clamp comprises an arc shaped second friction plate.

9. The light fixture of claim 8 wherein an arc of the arc shaped first friction plate is orthogonal to an arc of the second friction plate.

10. The light fixture of claim 5 wherein the first protrusion has an annular groove sized and shaped to mate with a first friction plate of the first end clamp when the tightening member is tightened.

11. The light fixture of claim 10 wherein the second protrusion has an annular groove sized and shaped to mate with a second friction plate of the second end clamp when the tightening member is tightened.

12. A light fixture comprising:

a joint housing having a first coupling aperture, a second coupling aperture, and a tightening bore;

an anchor having a first coupling, the first coupling having a first protrusion rotatably coupled to the first coupling aperture along a first axis;

a light housing assembly having a second coupling, the second coupling having a second protrusion rotatably coupled to the second coupling aperture along a second axis;

a clamp arm coupled to the joint housing, the clamp arm having a first end clamp and a second end clamp; and a tightening member operably coupled to the clamp arm through the tightening bore, wherein tightening the tightening member applies pressure from the first end clamp to the first protrusion and applies pressure from the second end clamp to the second protrusion, thereby limiting rotation in both the first and second axes.

13. The light fixture of claim 12 wherein the clamp arm is housed in the joint housing.

14. The light fixture of claim 12 wherein the second axis is offset from the first axis at an angle of between 60° and 120°.

15. The light fixture of claim 12 wherein the first end clamp has a first friction plate shaped to mate with at least a portion of a cross section of the first protrusion.

16. The light fixture of claim 12 wherein the first protrusion has a first annular groove mated with a first friction plate of the first end clamp and the second protrusion has a second annular groove mated with a second friction plate of the second end clamp.

17. The light fixture of claim 16 wherein tightening the tightening member: limits rotation of the first coupling aperture around the first protrusion by pressing the first friction plate on at least a portion of the first annular groove; and limits rotation of the second coupling aperture around the second protrusion by pressing the second friction plate on at least a portion of the second annular groove.

18. The light fixture of claim 16 wherein the first friction plate is sized and shaped to rotate entirely around the first annular groove and the second friction plate is sized and shaped to rotate around a majority the second annular groove but not rotate entirely around the second annular groove.

19. The light fixture of claim 12, further comprising:

a power cord housed within the light housing assembly, the joint housing, and the anchor, the power cord passing through the first and second coupling apertures from the anchor to the light housing assembly.

20. The light fixture of claim 12 wherein the clamp arm couples the anchor and the light housing assembly to the joint housing when the tightening member is threadedly coupled to the clamp arm through the tightening bore.

* * * * *